US009674605B2

(12) United States Patent
Beer et al.

(10) Patent No.: US 9,674,605 B2
(45) Date of Patent: Jun. 6, 2017

(54) LOUDSPEAKER WITH PRESSURE COMPENSATION ELEMENT

(71) Applicant: Fraunhofer-Gesellschaft zur Foerderung der angewandten Forschung e.V., Munich (DE)

(72) Inventors: Daniel Beer, Martinroda (DE); Lutz Ehrig, Dresden (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 187 days.

(21) Appl. No.: 14/732,238

(22) Filed: Jun. 5, 2015

(65) Prior Publication Data

US 2015/0271594 A1 Sep. 24, 2015

Related U.S. Application Data

(63) Continuation of application No. PCT/EP2013/075721, filed on Dec. 5, 2013.

(30) Foreign Application Priority Data

Dec. 6, 2012 (EP) ..... 102012222447

(51) Int. Cl.
*H04R 1/42* (2006.01)
*H04R 1/02* (2006.01)
(Continued)

(52) U.S. Cl.
CPC ..... *H04R 1/42* (2013.01); *H04R 1/02* (2013.01); *H04R 1/2803* (2013.01); *H04R 29/001* (2013.01)

(58) Field of Classification Search
CPC ..... H04R 1/42
(Continued)

(56) References Cited

U.S. PATENT DOCUMENTS 2,115,129 A 4/1938 Thienhaus
4,101,736 A 7/1978 Czerwinski et al.
(Continued)

FOREIGN PATENT DOCUMENTS

DE 245049 3/2012
JP S58106989 A 6/1983
(Continued)

OTHER PUBLICATIONS

Matzuk, T , "Improvement of Low-Frequency Response in Small Loudspeakers Systems by Means of the Stabilized Negative-Spring Principle", The Journal of the Acoustical Society of America, American Institute of Physics for the Acoustical Society of America, New York, NY, US, Bd. 49, Nr. 5, Part 81, Mai 1971 (1971-85), Seiten 1362-1367, XP888762847, ISSN: 8881-4966, DOI: 18.1121/1.19125.
(Continued)

*Primary Examiner* — Matthew Eason
*Assistant Examiner* — Phan Le
(74) *Attorney, Agent, or Firm* — Perkins Coie, LLP; Michael A. Glenn

(57) ABSTRACT

A loudspeaker includes a sound transducer, a housing and a unit configured to influence the temperature, such as a pressure compensation element. The sound transducer includes a membrane, the membrane enclosing a gas volume along with the housing. The sound transducer is configured to cause the membrane to vibrate, so that the gas volume is changed in accordance with the vibration. The unit configured to influence the temperature is configured to counteract a change of state, which is due to the membrane vibration, by means of a change in temperature of the gas volume.

19 Claims, 4 Drawing Sheets

(51) Int. Cl.
*H04R 1/28* (2006.01)
*H04R 29/00* (2006.01)

(58) Field of Classification Search
USPC ..... 381/345
See application file for complete search history.

(56) References Cited

U.S. PATENT DOCUMENTS

| | | | | |
|---|---|---|---|---|
| 4,356,882 | A | 11/1982 | Allen et al. | |
| 5,701,358 | A | 12/1997 | Larsen et al. | |
| 2003/0156728 | A1 | 8/2003 | Chatani et al. | |
| 2004/0136560 | A1* | 7/2004 | Walsh | H04R 9/06 381/401 |
| 2007/0104347 | A1 | 5/2007 | Stiles et al. | |
| 2009/0028370 | A1 | 1/2009 | Matsumura et al. | |
| 2010/0329494 | A1 | 12/2010 | Rouvala et al. | |
| 2012/0027239 | A1* | 2/2012 | Akino | H04R 1/28 381/345 |

FOREIGN PATENT DOCUMENTS

| | | | |
|---|---|---|---|
| JP | S5951699 | A | 3/1984 |
| JP | 63051182 | B | 10/1988 |
| JP | 01226296 | A | 9/1989 |
| JP | 1226296 | A | 8/1999 |
| JP | 2009175469 | A | 8/2009 |

OTHER PUBLICATIONS

Wright, Jr , "The Virtual Loudspeaker Cabinet", Journal of the Audio Engineering Society, Audio Engineering Society, New York, NY, Bd. 51, Nr. 4, Apr. 1, 2003 (Apr. 2003), Seiten 244-247, XP001177694, ISSN: 1549-4950, das ganze dokument.

* cited by examiner

LOUDSPEAKER WITH PRESSURE COMPENSATION ELEMENT

CROSS-REFERENCE TO RELATED APPLICATIONS

This application is a continuation of copending International Application No. PCT/EP2013/075721, filed Dec. 5, 2013, which is incorporated herein by reference in its entirety, and additionally claims priority from German Application No. 102012222447.5, filed Dec. 6, 2012, which is also incorporated herein by reference in its entirety.

BACKGROUND OF THE INVENTION

Embodiments of the present invention relate to a loudspeaker comprising a pressure compensation element.

Loudspeakers serve to convert an electric alternating signal, for example a sinusoidal signal, to sound or airborne sound. As is depicted in FIG. 3*a*, a loudspeaker 5 typically comprises a housing 10 having an enclosed volume $V_{14}$ (e.g. 5 l-10 l), and one or more sound transducers 12. The sound transducers 12, which are frequently configured as piston vibrators, typically include a membrane (diaphragm) 12*a* and a voice coil 12*b* as the drive.

The voice coil 12*b* is configured to cause, upon application of an alternating signal, the freely supported membrane 12*a* to vibrate. This results in an excursion of the membrane 12*a* or of parts thereof, both into the housing 10 and from the housing 10, so that the gas volume $V_{14}$ enclosed by the membrane 12*a* and the loudspeaker housing 10 is varied inside the housing 10. Starting from a closed housing 10, a change in pressure takes place inside the housing 10 because of the variation of the gas volume $V_{14}$ since said housing 10 is spatially separate from the external volume, and since, therefore, different pressure conditions may arise on the inside or outside of the membrane 12*a*. It shall be noted at this point that without said separation, pressure compensation processes may occur which are also referred to as acoustic short circuits and which result in clearly reduced sound generation.

Since the gas volume $V_{14}$ inside the housing 10 is compressed when the membrane 12*a* moves into the housing 10, the volume counteracts the movement of the membrane like a mechanical spring. The reason for this is that the compression process upon the membrane 12*a* (along with the drive 12*b*) moving into the housing results in the formation of an excess pressure in the gas volume $V_{14}$, which leads to a spring force $F_f$ of the gas volume $V_{14}$. This spring force counteracts the movement of the membrane during the compression process of $V_{14}$. It shall be noted that by analogy herewith, a spring force $-F_f$ results, when the membrane 12*a* moves out of the housing 10, due to an arising negative pressure in the gas volume $V_{14}$. The spring forces $F_f$ and $-F_f$ are proportional to the air spring rigidity $s_{14}$, which is dependent on the area of the membrane 12*a* and on the size of the gas volume $V_{14}$ within the loudspeaker housing 10. Thus, the air spring rigidity $s_{14}$ is proportional to $1/V_{14}$. The frequency response of a loudspeaker 5 and, thus, the sound quality are influenced substantially by the air spring rigidity $s_{14}$. A resulting frequency response for the loudspeaker 5 is depicted in FIG. 3*b*.

FIG. 3*b* outlines the of the sound pressure level p(f) across the frequency f of an idealized loudspeaker 5. In addition, the diagram depicts the impedance curve Z(f) across the frequency f. As can be seen from the amplitude frequency response p(f), the loudspeaker 5 has a lower cut-off frequency $f_G$ which is defined, for example, by the −6 dB point in the frequency response and amounts to 40 Hz, for example. From the impedance curve Z(f), the resonant frequency $f_R$ may be determined, which is located at the peak, or maximum, thereof and here amounts to 60 Hz, for example.

FIG. 3*c* shows a further loudspeaker 5' comprising a housing 10' and the sound transducer 12. The housing 10' comprises (as compared to the housing 10) a reduced gas volume $V_{14}'$ ($V_{14}'<V_{14}$) of, e.g., 0.5 liters or 1 liter. The reduced volume $V_{14}'$ results, in accordance with the above mentioned relationship $s_{14}'\sim 1/V_{14}'$, in increased spring rigidity $s_{14}'$ for the enclosed air volume $V_{14}$ ($s_{14}'>s_{14}$). Also, the size of the spring force $F_f$ to be overcome is crucially dependent upon the amount, in percent, by which the enclosed gas volume $V_{14}'$ is reduced or increased by the movement of the membrane into the housing 10' or out of same, respectively. The larger the percentage change in volume, the larger the force $F_m$ or $-F_m$ that may be exerted in order to overcome the air spring. This results in that given the same size of the membrane 12*a* and the same deflection thereof, in a smaller housing 10' or gas volume $V_{14}'$, a larger force $F_m$ or $-F_m$ may be used, due to the increased air spring rigidity $s_{14}'$, in order to overcome the air spring than for a larger housing 10 or gas volume $V_{14}$. Since, as was explained above, the transmission characteristic is dependent on the spring rigidity $s_{14}'$, a change or reduction in size of the housing 10' results, when the same sound transducer 12 (chassis) is used, in a change in the frequency band, as is depicted in FIG. 3*d*. It shall be noted that the overall rigidity of the chassis 12 is composed of the air spring rigidity s and the rigidity of the membrane suspension. Consequently, the air spring rigidity s is important in particular when it is no longer negligible as compared to the rigidity of the suspension of the membrane, e.g. with small loudspeaker housings 10' (having a small gas volume $V_{14}'$).

FIG. 3*d* shows a diagram of the impedance curve Z(f)' and the amplitude frequency response p(f)' for the loudspeaker 5' of FIG. 3*c* (plotted across the frequency f). As can be seen from the impedance curve Z(f)', the resonant frequency $f_R'$ is shifted upward due to the smaller housing 10' and is now at 100 Hz, for example. Likewise, the lower cut-off frequency $f_G'$ is increased (e.g. to 80 Hz), as may be seen from the amplitude frequency response p(f)'. In addition, in the amplitude frequency response p(f)', a resonance step-up is formed in the range of the resonant frequency $f_R'$, which has a negative impact on the linearity of the frequency response p(f)'.

In many cases of application, there is the desire, in particular for optical reasons, to have a loudspeaker housing 10 that is as small as possible and that accommodates potential electronics for controlling the sound transducer 12 (e.g. frequency separator, amplifier). Even when the size of the membrane 12*a* remains unchanged, the size of the housing 10 or 10' may be varied within a limited range. However, since the size of the housing 10 or 10' has a direct impact on the linearity of the frequency response p(f) or p(f)' and the transmission range, in particular, the lower transmission range (cf. lower cut-off frequency $f_G$ or $f_G'$), as was explained above, there is a conflict between the size of the loudspeaker 5 or 5' and the sound quality.

SUMMARY

According to an embodiment, a loudspeaker may have: a sound transducer including a membrane; a housing which encloses, along with the membrane, a gas volume; and a temperature-influencing unit configured to influence the temperature of the gas volume, the membrane being configured to vibrate so that the gas volume is changed in accordance with a vibration, and the unit configured to influence the temperature including a first pressure compensation element configured to cool the gas volume, and a second pressure compensation element configured to heat the gas volume, so that the unit configured to influence the temperature is configured to counteract a change of state, which is due to the vibration, by means of a time-variable change in temperature, which depends on the audio signal, in the gas volume.

According to another embodiment, a loudspeaker may have: a sound transducer including a membrane; a housing which encloses, along with the membrane, a gas volume; and a temperature-influencing unit configured to influence the temperature of the gas volume, the membrane being configured to vibrate so that the gas volume and, thus, the pressure in the gas volume, are changed in accordance with a vibration, and the unit configured to influence the temperature including a first pressure compensation element configured to cool the gas volume, and a second pressure compensation element configured to heat the gas volume, so that the unit configured to influence the temperature is configured to counteract a first change of state, which is due to the vibration, by means of a change in temperature of the gas volume, said change in temperature causing a second change in pressure, said change in temperature being proportional to said second change in pressure.

Embodiments of the present invention provide a loudspeaker comprising a sound transducer, a housing and means for influencing the temperature, such as a pressure compensation element. The sound transducer comprises a membrane, said membrane including a gas volume along with the housing. The sound transducer is configured to cause the membrane to vibrate, so that the gas volume is changed in accordance with the vibration. The means for influencing the temperature is configured to counteract the change of state, which is due to the membrane vibration, by means of a change in temperature of the gas volume.

The finding of the present invention consists in that the adiabatic change of state of the gas volume inside the loudspeaker, which is caused by the movement of the membrane and the change in volume resulting therefrom, is transferred to an isobaric change of state. In this context, for example, heat is input into the gas volume, or the gas volume is subjected to a cooling process, so that the pressure change inside the housing is compensated or nearly compensated for. This is why in the inventive loudspeakers, means for achieving an isobaric change of state, such as one or more so called pressure compensation elements, which are in direct contact with the gas volume and/or can act upon same are provided, e.g., inside the housing. By means of the pressure adaptation, the air spring rigidity s in the gas volume may be adapted or kept constant, e.g. as a function of the movement of the membrane, so that a loudspeaker within a small housing having a small enclosed gas volume exhibits an air spring rigidity s that is comparable to that present within a large housing having a large enclosed gas volume. Consequently, the frequency response of loudspeakers having such pressure compensation elements improves, so that, for example, the critical frequencies of "resonant frequency $f_R$" and "lower cut-off frequency $f_G$" are reduced. This results in transmission characteristics having increased linearity and an enlarged playback frequency range.

Since in a loudspeaker the membrane of the sound transducer may be caused to vibrate, the pressure compensation element may thus be—in accordance with further embodiments—electrically coupled to the sound transducer, for example via pressure sensors or via direct coupling to the audio signal, so as to control the pressure compensation element and thus the isobaric changes of state in accordance with the vibration of the membrane as regards amplitude and time characteristic.

Since the sound transducer typically performs a movement into the housing as well as out of the housing, the loudspeaker may comprise—in accordance with further embodiments—both pressure compensation elements configured to perform a temperature increase of the gas volume and further pressure compensation elements by means of which a temperature reduction may be performed. Said heatable pressure compensation elements may be configured as nanotubes, for example, whereas the coolable pressure compensation elements may be configured as passive or active heat sinks or as Peltier elements. Moreover, said pressure compensation elements may be controllable, for example electronically, in their thermal behavior. In order to perform the isobaric change of state as fast as possible, the pressure compensation elements are configured inside the housing such that they have large volumes and/or very large surfaces, for example with the aid of lamellae or a foam.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
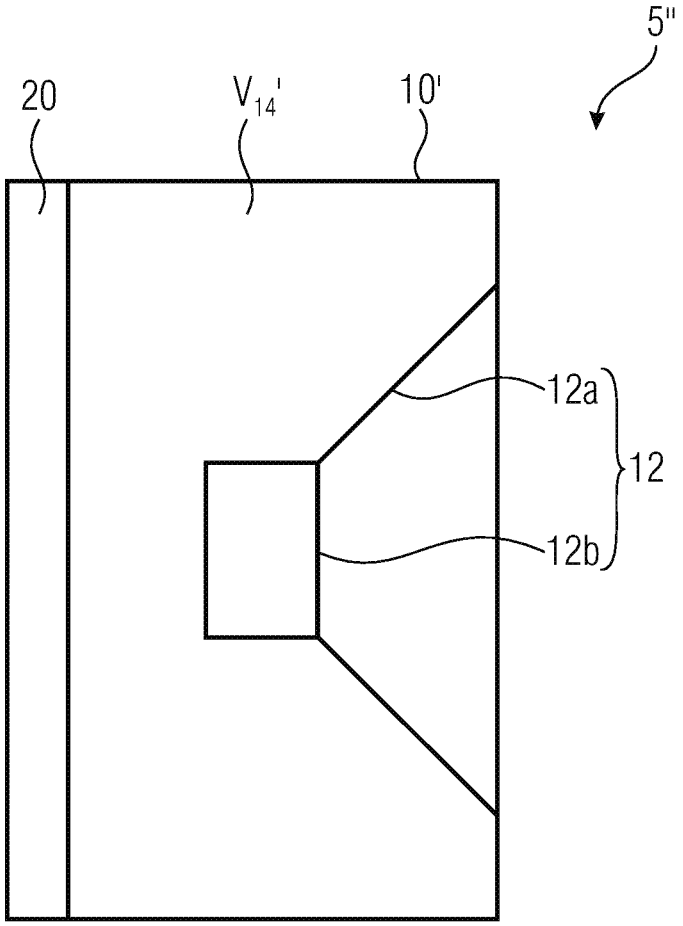
FIG. 1 shows a schematic representation of a loudspeaker comprising a pressure compensation element in accordance with an embodiment.

Before embodiments of the present invention shall be described below in the following by means of the accompanying figures, it shall be noted that elements that are identical or identical in action are provided with identical reference numerals and that their descriptions are mutually applicable or exchangeable.

FIG. 1 shows a loudspeaker 5" comprising the sound transducer 12 (piston vibrator), which comprises the membrane 12*a* and the drive coil 12*b*. As was described above, the membrane 12*a* along with the housing 10' encloses the internal volume $V_{14}'$ filled with a gas. In the depicted loudspeaker 5", a pressure compensation element 20 is also arranged inside the housing 10'. To be precise, the pressure compensation element 20 is arranged such that it is in contact with the gas volume $V_{14}'$ or the air or, generally, the ideal gas that is inside.

Inside the housing 10', there is a connection, for ideal gasses, between the existing pressure $p_{14}'$, the enclosed gas volume $V_{14}'$, and the existing temperature $T_{14}'$. Without the pressure compensation element 20, a movement of the membrane 12*a* into the housing 10' would result in an increase in pressure ($+\Delta p_{14}'$) since the volume $V_{14}'$ is reduced. Conversely, a movement of the membrane 12*a* out of the housing 10' results in a reduction in pressure ($-\Delta p_{14}'$) since the volume $V_{14}'$ increases. Such changes of state are referred to as adiabatic since no thermal energy is exchanged with the environment. In the present configuration of the loudspeaker, i.e. when employing the pressure compensation element 20, the pressure difference $+\Delta p_{14}'$ or $-\Delta p_{14}'$ is compensated for by a change in temperature of the gas volume $V_{14}'$, and/or the adiabatic change of state is transferred to an isobaric change of state. Since the pressure $p_{14}'$ is proportional to $T_{14}'/V_{14}'$, an increase in the pressure $+\Delta p_{14}'$ may be compensated for by a reduction in temperature $-\Delta T_{14}'$. Conversely, a negative pressure $-p_{14}'$ may be compensated for by an increase in temperature $+\Delta T_{14}'$, in accordance with the relationship $p_{14}' \sim T_{14}'/V_{14}'$. Thus, the change in the thermodynamic states in the gas volume $V_{14}'$ is effected, on the one hand, by the change in volume of the membrane 12*a* and, on the other hand, by an actively controlled change in temperature of the gas.

The pressure compensation element 20 may be a kind of heating element, for example, which upon application of a heating voltage heats itself and, thus, the surrounding gas molecules of the gas volume $V_{14}'$. To this effect, the pressure compensation element may comprise one or more thermoacoustic transducing elements such as tungsten filaments and/or carbon nanotubes, for example, that are configured to very quickly perform a change in temperature of the surrounding gas volume $V_{14}'$ and to also cyclically repeat same (e.g. with at least 40 Hz or the frequencies of the rigidity dominated frequency range ($f<f_R$)). Such pressure compensation elements 20 advantageously exhibit high electrical and thermal conductivities as well as low thermal capacity. The heating-up of the pressure compensation elements 20 results in the expansion of the gas volume $V_{14}'$ surrounding the pressure compensation element 20. This heating-up $+\Delta T_{14}'$ is advantageously effected in a cyclic manner, which may be achieved, for example, by cooling-down breaks ($-\Delta T_{14}'$), so that oscillating changes in pressure $+/-\Delta p_{14}'$, which are caused by the loudspeaker membrane 12*a* moving back and forth, can at best be fully compensated for. So that this increase in temperature $+\Delta T_{14}'$ is effected in a targeted manner upon an outward movement of the membrane 12*a*, the pressure compensation element 20 is advantageously electrically coupled to the sound transducer 12. Here, the heating voltage may be derived, for example, from the oscillating alternating signal for driving the sound transducer 12. Thus, the heating voltage cyclically varies as a function of the alternating signal (high-level signal) for driving the sound transducer 12.

In accordance with further embodiments, the pressure compensation element 20 may also be configured to effect a reduction in temperature $-\Delta T_{14}'$ of the gas volume $V_{14}'$ surrounding the pressure compensation element 20. Possible implementations for such a cooling pressure compensation element 20 are, for example, passive heat sinks or active cooling elements, for example Peltier elements, which may be coupled, by analogy with the above embodiment, to the electrical high-level signal (via a control voltage). Since upon emission of a tone by means of the sound transducer 12, normally a movement of the membrane 12*a* both into the housing 10' and out of the housing 10' takes place, the pressure compensation element 20 advantageously includes a combination of heating and cooling pressure compensation elements 20. It shall be noted at this point that this combination may also be realized in that the housing 10' has arranged therein a first pressure compensation element 20 configured to cool the gas volume $V_{14}'$ and a second pressure compensation element 20 configured to heat the gas volume $V_{14}'$. This combination is advantageous, in particular, with large pressure fluctuations $+/-\Delta p_{14}'$ to be compensated for, which are associated with large temperature fluctuations $+/-\Delta T_{14}'$.

In accordance with further embodiments, the pressure compensation elements 20 and/or a controller (not depicted) for the pressure compensation elements 20 are configured such that the pressure compensation elements 20 advantageously operate below the fundamental resonant frequency of the sound transducer 12 (i.e. for example, within a frequency range between 20 and 50 or 25 and 100 Hz). The background to this is that negative effects on the linearity of sound transducers that are due to air compression inside the housing practically only occur within the lower frequency range, i.e. below the resonant frequency $f_R$ (e.g. below 70 Hz or below 120 Hz), and/or that the effects within said frequency range are particularly severe since within said frequency range, the vibration behavior is determined by the rigidity of the overall system.

Figure 2A:
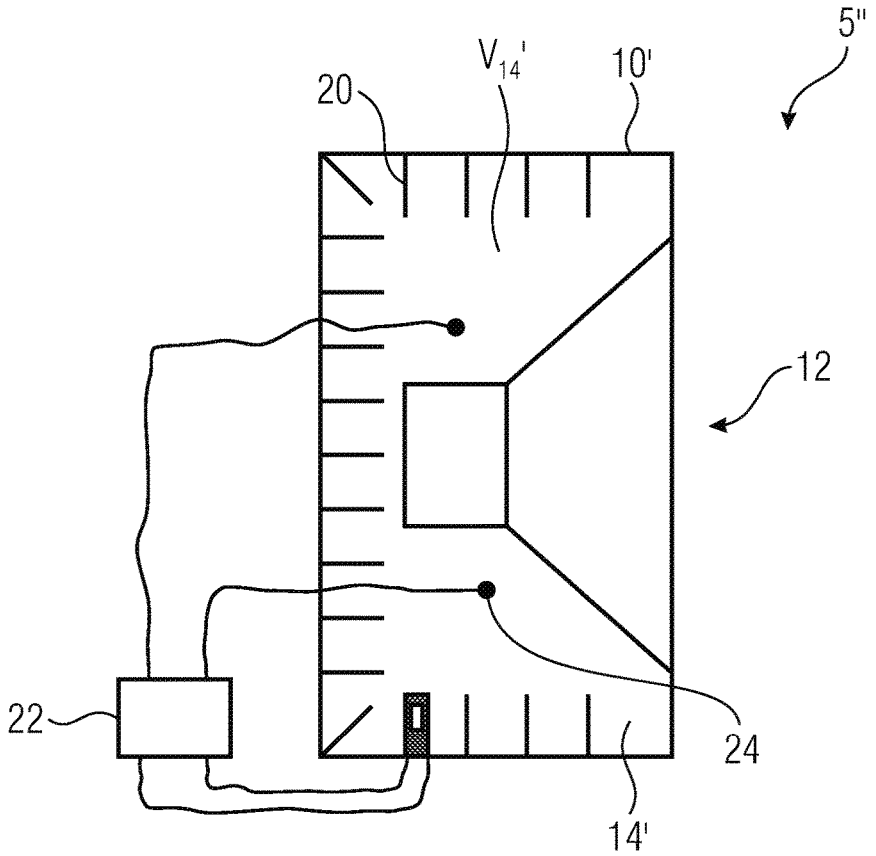
FIG. 2*a* shows a schematic representation of a loudspeaker comprising several pressure compensation elements and a controller in accordance with a further embodiment.

FIG. 2*a* shows a further implementation of a loudspeaker 5" comprising a multitude of pressure compensation elements 20. Here, the multitude of temperature-influencing elements 20 are suitably arranged and combined with one another, so that the achievable temperature difference $+/-\Delta T_{14}'$ that can be introduced into the gas volume $V_{14}'$ is increased. As was already explained above, the multitude of pressure compensation elements 20 may be realized by a combination of heating and cooling elements that are operated in an active and/or passive manner. As can be seen from FIG. 2*a*, the temperature compensation elements 20 are spatially arranged such that, on the one hand, the contact area between the elements 20 and the gas in the gas volume $V_{14}'$ is maximized, and, on the other hand, the distance between the element 20 and a (most) remote gas molecule is minimized (avoidance of isolated introduction of heat/coldness) so as to reduce the duration of the temperature compensation $+/-\Delta T_{14}'$. In this implementation, surface maximization results from the fact that the pressure compensation elements 20 are arranged in the form of lamellae.

In accordance with further embodiments, the embodiment of FIG. 2*a* additionally comprises the depicted control electronics 22, which couples the heating voltage and/or the electrical control voltage for the cooling elements to the pressure compensation elements 20 as a function of the alternating signal for driving the sound transducer 12. To this effect, the control electronics 20 may comprise means for avoiding frequency doubling, in accordance with further embodiments. The background to this is that when a positive or a negative electrical voltage is present, which is derived, for example, from the high-level signal, the respective pressure compensation element 20 (e.g. the heating element) is driven even when the membrane 12 moves to a different direction in the event of a negative voltage as compared to the event of a positive voltage. In order to avoid this effect of frequency doubling, the entire signal may be shifted, for example, with the aid of a suitable amplitude offset. The offset is configured such that all of the amplitude values occurring comprise the same sign. In detail, it may be useful to select the offset large enough so that the largest negative signal amplitude value becomes the smallest positive amplitude value.

In accordance with further embodiments, the controller 22 may be connected to a sensor 24 arranged inside the housing 10'. This sensor 24 (e.g. pressure or temperature sensor) serves to determine thermodynamic state variables such as the pressure or temperature and to therefrom adapt or even derive the control signal for the pressure compensation elements 20. Determination of the useful control signal may be derived from the sensor signal, for example by means of a once-only measurement, and may be adjusted. In this manner, calibration is enabled by the sensor 24. In addition, it is also possible for the control signals (cf. here heating voltage and/or control voltage of the (active) cooling elements or Peltier elements) for the pressure compensation elements 20 to be adaptively determined by means of real-time processing of the sensor signals (semi-active control) and/or to be derived directly from the sensor signals (fully active control). It shall be noted at this point that the sensor 24 may also be configured as a sensor network that includes a multitude of sensors arranged inside the housing 10'.

Figure 2B:
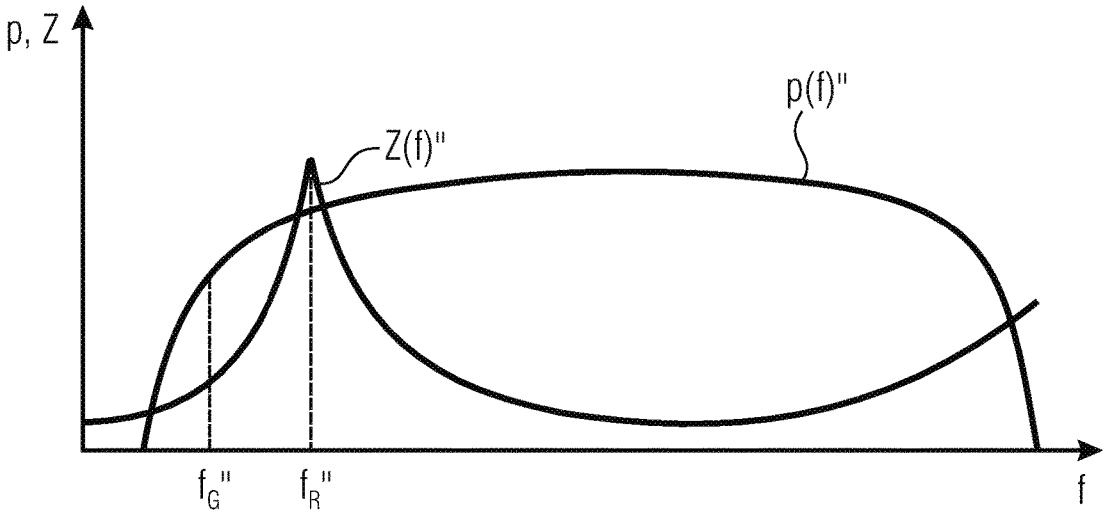
FIG. 2*b* shows a schematic diagram of the frequency response of the embodiment of FIG. 2*a;*

In the following, the resulting frequency response for the loudspeaker 5" comprising the means for compensating for the spring rigidity s in small housings 10' will be discussed with reference to FIG. 2*b*. FIG. 2*b* shows a diagram of the impedance curve Z(f)" and the amplitude curve p(f)" for the loudspeaker housing 5".

Figure 3A:
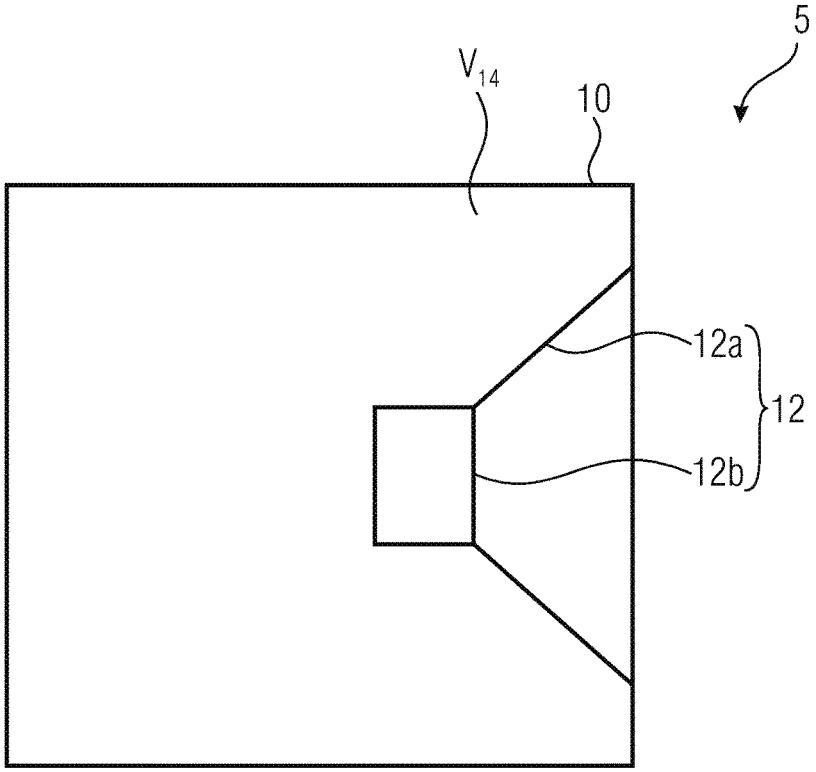
FIG. 3*a* shows a schematic representation of a loudspeaker in accordance with conventional technology.
Figure 3B:
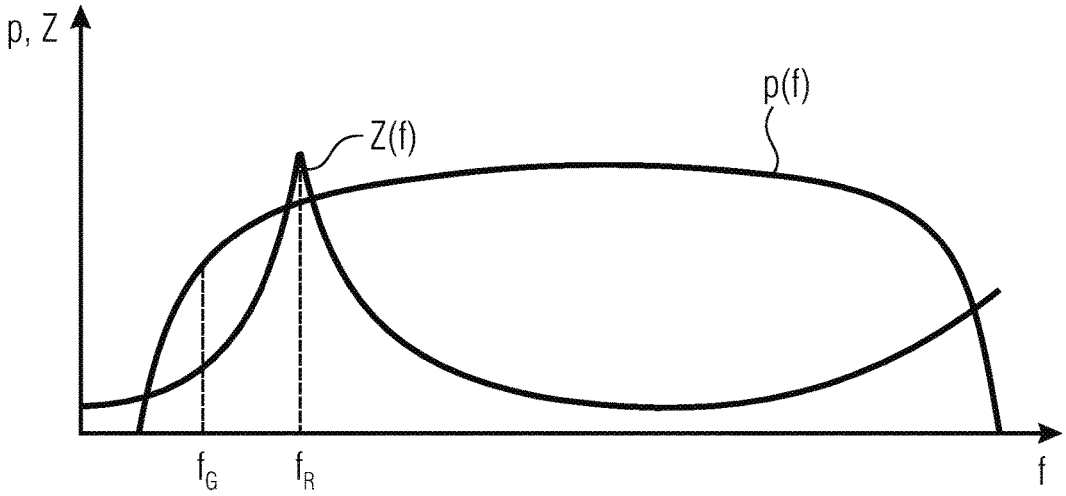
FIG. 3*b* shows a schematic diagram of the frequency response of the loudspeaker of FIG. 3*a;*
Figure 3C:
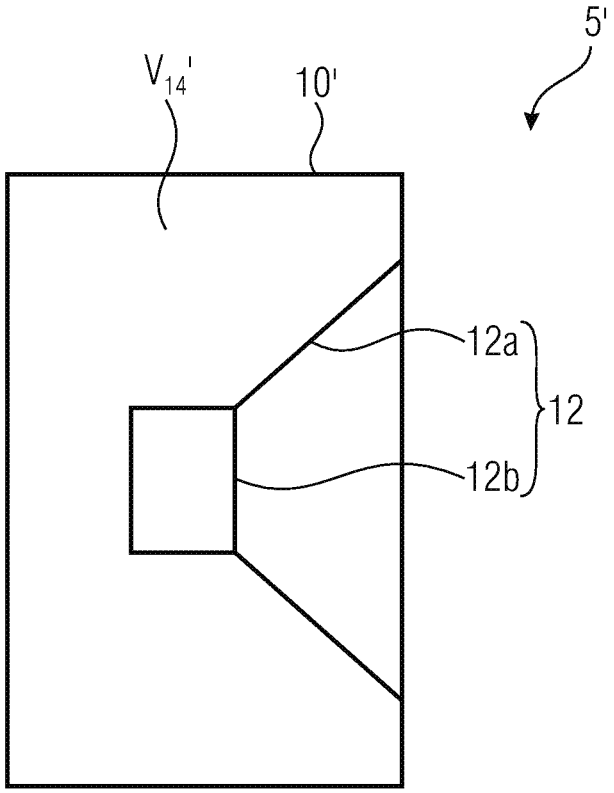
FIG. 3*c* shows a schematic representation of a further loudspeaker in accordance with conventional technology.
Figure 3D:
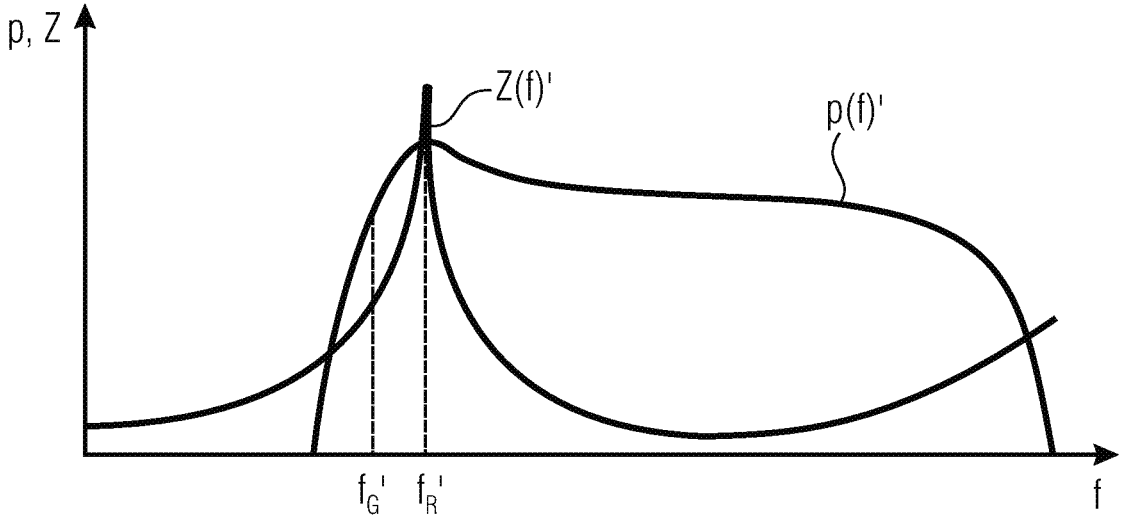
FIG. 3*d* shows a schematic diagram of the frequency response of the loudspeaker of FIG. 3*c.*

As compared to the diagram of FIG. 3*b*, one can see that the resonant frequency $f_R$" is configured to be substantially lower than the resonant frequency $f_R$'. In addition, the curve also does not exhibit such a highly pronounced maximum. Consequently, the frequency response p(f)" is smoothened as compared to the frequency response p(f)" in the frequency range around the resonant frequency $f_R$" and is thus characterized by an approximately linear curve in said frequency range. The frequency response p(f)" moreover reveals that the lower cut-off frequency $f_G$" reaches down much further and thus is more similar to the frequency response of FIG. 3*b* for the large-volume loudspeaker 5 than to the frequency response of FIG. 3*d* for the small-volume loudspeaker 5', even though in the loudspeaker housing 5" employed, the volume is not changed as compared to the loudspeaker 5'. In summary, it can be stated that the frequency characteristic is considerably improved in terms of linearity and frequency spectrum as compared to a conventional loudspeaker despite the small gas volume $V_{14}$'.

With reference to FIG. 2*a*, it shall be noted that even when the pressure compensation elements 20 are configured as lamellae, with the integrated pressure compensation elements 20 a maximum surface area may be achieved by means of other forms, such as a gas-permeable filling material filling up the entire housing 10', so as to finally achieve the goal of fast temperature compensation processes $+/-\Delta T_{14}$'. This filling material may be an open-pore foam or a wool or tissue. In addition, it would also be feasibly for the pressure compensation elements 20 to be applied as a film or lacquer inside the housing 10'. Fundamentally, care is to be taken in any embodiments that the mechanism of action of the temperature-influencing element is ensured despite maximization of the active surface area. In case nanotubes are used as the foam, for example, care is to be taken to ensure galvanic coupling of all of the pores. In addition, it shall be noted that further approaches to achieving fast temperature compensation processes $+/-\Delta T_{14}$' are feasible. For example, the choice of materials and, in this context, in particular the thermal conductivity of the components used play an essential part. Optimization possibilities primarily exist in the choice of the medium (gas) within the volume $V_{14}$', which is selected, e.g. such that it exhibits high thermal conductivity. In general terms, this means that the gas employed advantageously is a gas which enables (despite the existing inertia in temperature propagation processes) optimum, or fast, propagation of temperature changes $+/-\Delta T_{14}$' in the entire gas volume $V_{14}$' so as to achieve the above-mentioned goal regarding an ability to change temperature more quickly.

It shall also be noted at this point that even though the above-discussed embodiments referred to closed housings 10', in particular, the pressure compensation elements 20 can also be employed in other types of housings such as housings comprising passive membranes or in bass-reflex housings, for example. In other words, this means that the enclosed gas volume $V_{14}$' does not necessarily need to be enclosed in an airtight manner.

In addition it shall be noted that the loudspeaker 5" depicted with reference to FIGS. 1 and 2 may comprise a multitude of sound transducers 12. Likewise, the sound transducer depicted as a piston vibrator with a funnel-shaped membrane in the above description may also be configured differently.

Even though in the preceding embodiments, the means for influencing the temperature were described as pressure compensation elements, it shall be noted at this point that same can also be configured differently. In addition, they do not necessarily need to be arranged inside the housing. In accordance with embodiments it would also be feasible for the means for influencing the temperature to influence the temperature of the gas in the gas volume from outside, e.g. by means of (heat) radiation, so that consequently, pressure compensation occurs inside. In general terms, this means that the means for influencing the temperature are configured, irrespective of the temperature generation effect employed in each case and of the arrangement of the means in relation to the loudspeaker housing, to change a temperature in the gas volume and to thus perform pressure compensation.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A loudspeaker comprising:

a sound transducer comprising a membrane;

a housing which encloses, along with the membrane, a gas volume; and a temperature-influencing unit configured to influence the temperature of the gas volume, the membrane being configured to vibrate so that the gas volume is changed in accordance with a vibration, and the unit configured to influence the temperature comprising a first pressure compensation element configured to cool the gas volume, and a second pressure compensation element configured to heat the gas volume, so that the unit configured to influence the temperature is configured to counteract a change of state, which is due to the vibration, by means of a time-variable change in temperature, which depends on the audio signal, in the gas volume.

2. A loudspeaker comprising:

a sound transducer comprising a membrane;

a housing which encloses, along with the membrane, a gas volume; and a temperature-influencing unit configured to influence the temperature of the gas volume, the membrane being configured to vibrate so that the gas volume and, thus, the pressure in the gas volume, are changed in accordance with a vibration, and the unit configured to influence the temperature comprising a first pressure compensation element configured to cool the gas volume, and a second pressure compensation element configured to heat the gas volume, so that the unit configured to influence the temperature is configured to counteract a first change of state, which is due to the vibration, by means of a change in temperature of the gas volume, said change in temperature causing a second change in pressure, said change in temperature being proportional to said second change in pressure.

3. The loudspeaker as claimed in claim 1, wherein the unit configured to influence the temperature comprises a pressure compensation element configured to effect the change in temperature of the gas volume so as to counteract a change in pressure of the gas volume that is due to the vibration.

4. The loudspeaker as claimed in claim 3, wherein the pressure compensation element is configured to effect, when a heating voltage is present, an increase in the temperature of the gas volume surrounding the pressure compensation element.

5. The loudspeaker as claimed in claim 3, wherein the pressure compensation element comprises a thermoacoustic transducer element and/or carbon nanotubes.

6. The loudspeaker as claimed in claim 3, wherein the pressure compensation element is arranged inside the housing in the form of a tissue, a film or a lacquer.

7. The loudspeaker as claimed in claim 3, wherein the pressure compensation element is configured to achieve, when an oscillating heating voltage is present, an oscillating expansion of the gas volume.

8. The loudspeaker as claimed in claim 3, wherein the pressure compensation element is configured to effect a reduction in temperature of the gas volume surrounding the pressure compensation element.

9. The loudspeaker as claimed in claim 3, wherein the pressure compensation element comprises a passive heat sink and/or a Peltier element.

10. The loudspeaker as claimed in claim 4, further comprising another pressure compensation element configured to effect a reduction in temperature of the gas volume surrounding the pressure compensation element.

11. The loudspeaker as claimed in claim 3, further comprising an electric circuit configured to electrically couple the pressure compensation element to an alternating signal for driving the sound transducer.

12. The loudspeaker as claimed in claim 11, wherein the electric circuit comprises a frequency doubling avoidance unit configured to avoid frequency doubling.

13. The loudspeaker as claimed in claim 11, wherein the electric circuit is configured to electrically couple the pressure compensation element only below the cut-off resonant frequency of the sound transducer.

14. The loudspeaker as claimed in claim 11, wherein the electric circuit is configured to control the pressure compensation element by means of a control signal derived from the alternating signal for driving the sound transducer, so that the vibration of the membrane that is controlled by means of the alternating signal is supported.

15. The loudspeaker as claimed in claim 3, wherein the electric circuit is connected to a pressure sensor inside the housing, so that the pressure compensation element may be driven on the basis of a detected change in pressure.

16. The loudspeaker as claimed in claim 3, wherein the pressure compensation element is arranged inside the housing by means of lamellae or an open-pore foam so as to form a maximum surface area.

17. The loudspeaker as claimed in claim 3, wherein the housing is closed.

18. The loudspeaker as claimed in claim 3, wherein the gas volume is configured to perform an adiabatic and isobaric change of state.

19. The loudspeaker as claimed in claim 2, wherein the first and second pressure changes are inverse to each other.

* * * * *